US007287452B1

(12) United States Patent
Tsai

(10) Patent No.: US 7,287,452 B1
(45) Date of Patent: Oct. 30, 2007

(54) SCREW FASTENER ASSEMBLY

(76) Inventor: Allen Tsai, 11F, No. 58, Sec. 3, Min-Chuan E. Rd., Taipei (TW)

( * ) Notice: Subject to any disclaimer, the term of this patent is extended or adjusted under 35 U.S.C. 154(b) by 0 days.

(21) Appl. No.: 11/487,645

(22) Filed: Jul. 17, 2006

(51) Int. Cl.
*B25B 23/08* (2006.01)
*B25B 9/00* (2006.01)

(52) U.S. Cl. ..... 81/451; 81/13

(58) Field of Classification Search ..... 81/451, 81/13

See application file for complete search history.

(56) References Cited

U.S. PATENT DOCUMENTS 1,360,500 A * 11/1920 Coll ..... 81/458
2,723,694 A * 11/1955 Ross ..... 81/451
4,221,249 A * 9/1980 Mazzeo et al. ..... 81/451
5,065,649 A * 11/1991 Evers et al. ..... 81/458
6,116,125 A * 9/2000 McLeod ..... 81/456

* cited by examiner

*Primary Examiner*—David B Thomas
(74) *Attorney, Agent, or Firm*—Butzel Long

(57) ABSTRACT

A screw fastener assembly includes a resilient sleeve sleeved on a head portion of the screw fastener in a close-fitting manner such that a free end of a shank portion of the screw fastener extends outwardly of a first end of the sleeve. The sleeve permits extension of a bit of a screw driver thereinto via a second end thereof, and is sleeved on the screw driver in a close-fitting manner. An engaging groove in the head portion of the screw fastener engages the bit of the screw driver such that the screw driver is capable of moving and rotating an assembly of the screw fastener and the sleeve until the first end of the sleeve comes into contact with a surface of an object so as to allow movement of the screw fastener relative to the sleeve and a threaded hole in the object.

2 Claims, 4 Drawing Sheets

SCREW FASTENER ASSEMBLY

BACKGROUND OF THE INVENTION

1. Field of the Invention

The invention relates to a screw fastener, more particularly to a screw fastener assembly.

2. Description of the Related Art

FIG. 1 illustrates a part of a pair of eyeglasses that employs a conventional screw 11 for coupling a nose pad 100 to a pad-mounting seat 130. The conventional screw 11 generally has a small size. As such, during assembly of the nose pad 100, such a small screw 11 is hard to align with a threshold hole 131 in the pad-mounting seat 13, and on the other hand, during disassembly of the nose pad 100, a screw driver 13 is difficult to align with a head portion 111 of the conventional screw 11, thereby resulting in a troublesome driving operation of the conventional screw 11.

SUMMARY OF THE INVENTION

Therefore, the object of the present invention is to provide a screw fastener assembly that can overcome the aforesaid drawbacks of the prior art.

According to the present invention, there is provided a screw fastener assembly adapted for use with an object. The object has a surface formed with a threaded hole. The screw fastener assembly comprises:

- a screw fastener having a shank portion that has a connecting end and a free end which are opposite to each other, and a head portion connected to the connecting end of the shank portion, the head portion having an engaging side formed with an engaging groove; and
- a resilient sleeve having opposite first and second ends, the sleeve being sleeved on the head portion of the screw fastener in a close-fitting manner such that the free end of the shank portion of the screw fastener extends outwardly of the first end of the sleeve.

The sleeve is adapted to permit extension of a bit of a screw driver thereinto via the second end, and is adapted to be sleeved on the screw driver in a close-fitting manner. The engaging groove in the engaging side of the head portion of the screw fastener is adapted to engage the bit of the screw driver such that the screw driver is capable of moving and rotating an assembly of the screw fastener and the sleeve until the first end of the sleeve comes into contact with the surface of the object so as to allow movement of the screw fastener relative to the sleeve and the threaded hole in the object.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
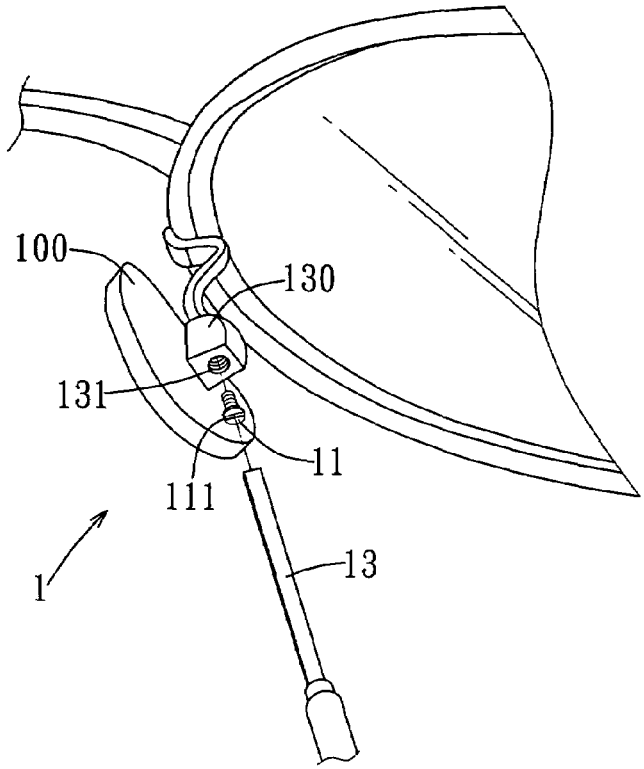
FIG. 1 PRIOR ART
FIG. 1 is a fragmentary perspective view illustrating a conventional screw when screwed into a pad-mounting seat of a pair of eyeglasses so as to couple a nose pad to the pad-mounting seat.

Before the present invention is described in greater detail, it should be noted that like elements are denoted by the same reference numerals throughout the disclosure.

Figure 2:
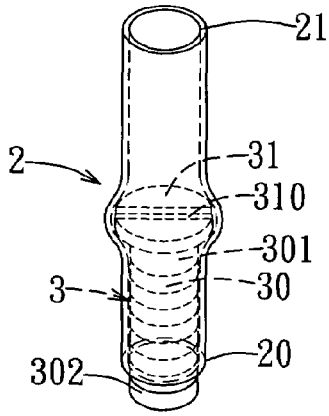
FIG. 2 is a perspective view showing the first preferred embodiment of a screw fastener assembly according to the present invention.
Figure 3:
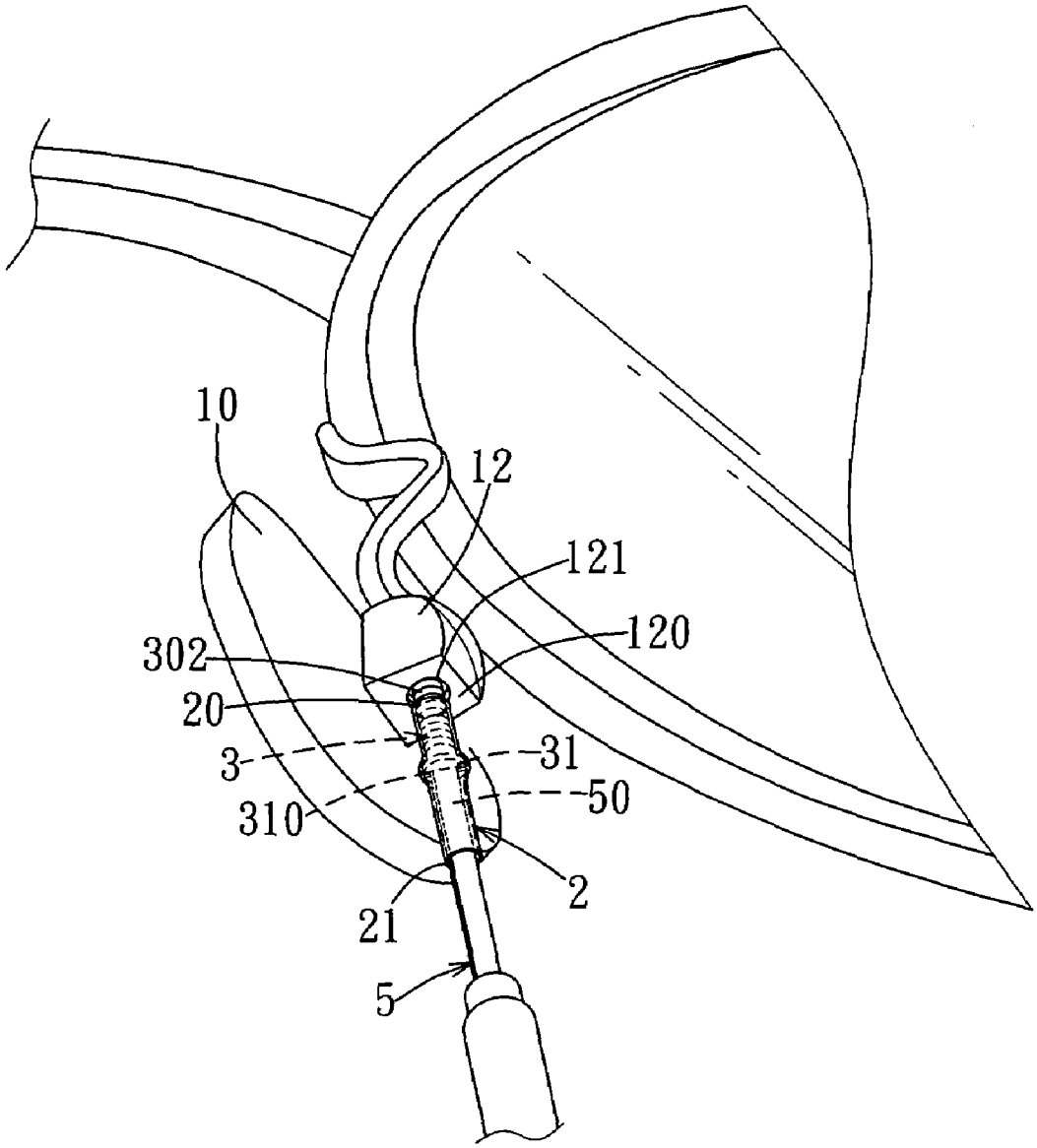
FIG. 3 is a fragmentary perspective view illustrating the first preferred embodiment when used to anchor a nose pad to a pad-mounting seat.

Referring to FIGS. 2 and 3, the first preferred embodiment of a screw fastener assembly according to the present invention is shown to be adapted for use with an object. In this embodiment, the object is a pad-mounting seat 12 of a pair of eyeglasses for mounting a nose pad 10. The pad-mounting seat 12 has a surface 120 formed with a threaded hole 121. The screw fastener assembly includes a screw fastener 3 and a resilient sleeve 2.

The screw fastener 3, such as a tiny screw suitable for coupling the nose pad 10 to the pad-mounting seat 12, has a shank portion 30 that has a connecting end 301 and a free end 302 which are opposite to each other, and a head portion 31 connected to the connecting end 301 of the shank portion 30. The head portion 31 has an engaging side formed with an engaging groove 310.

The resilient sleeve 2 has opposite first and second ends 20, 21. The sleeve 2 is sleeved on the head portion 31 of the screw fastener 3 in a close-fitting manner such that the free end 302 of the shank portion 30 of the screw fastener 3 extends outwardly of the first end 20 of the sleeve 2.

Figure 4:
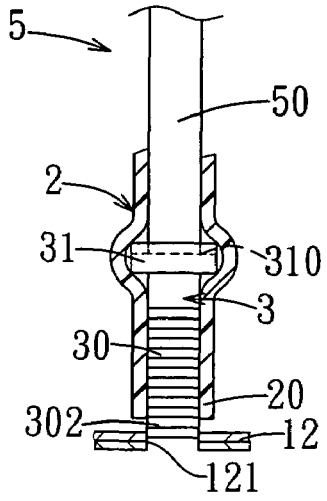
FIG. 4 is a fragmentary schematic sectional view showing the first preferred embodiment when a screw fastener is aligned with a threaded hole in the pad-mounting seat.
Figure 5:
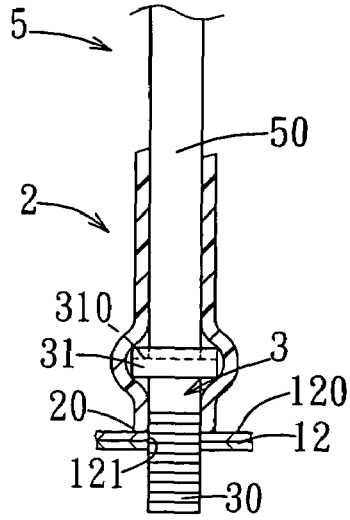
FIG. 5 is a fragmentary schematic sectional view showing the first preferred embodiment when the screw fastener is screwed into the threaded hole in the pad-mounting seat.

In actual use, the sleeve 2 is adapted to permit extension of a bit 50 of a screw driver 5 thereinto via the second end 21, and is adapted to be sleeved on the screw driver 5 in a close-fitting manner, as shown in FIG. 2. The engaging groove 310 in the engaging side of the head portion 31 of the screw fastener 3 is adapted to engage the bit 50 of the screw driver 5 such that the screw driver 5 is capable of moving and rotating an assembly of the screw fastener 3 and the sleeve 2, as shown in FIG. 4, until the first end 20 of the sleeve 2 comes into contact with the surface 120 of the pad-mounting seat 12 so as to allow movement of the screw fastener 3 relative to the sleeve 2 and the threaded hole 121 in the pad-mounting seat 12, as shown in FIG. 5.

Figure 6:
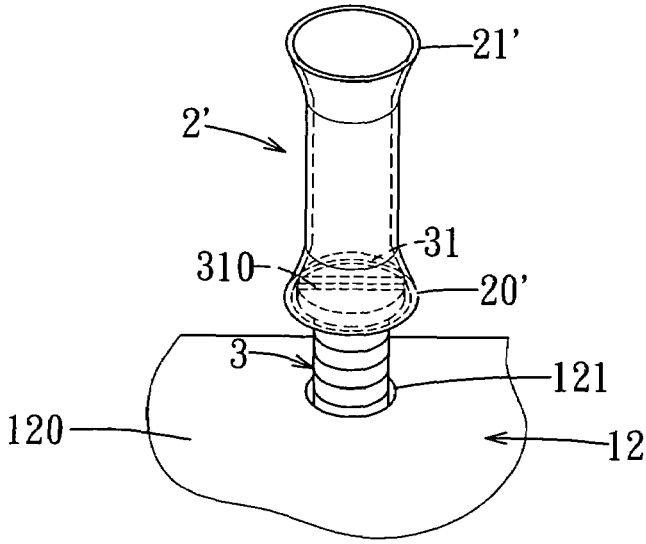
FIG. 6 is a perspective view showing the second preferred embodiment of a screw fastener assembly according to the present invention.
Figure 7:
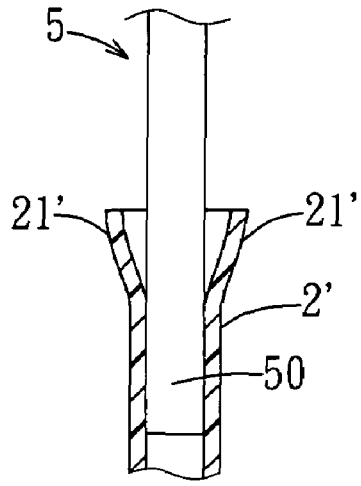
FIG. 7 is a fragmentary schematic sectional view showing the second preferred embodiment when a resilient sleeve is sleeved on a screw driver.
Figure 8:
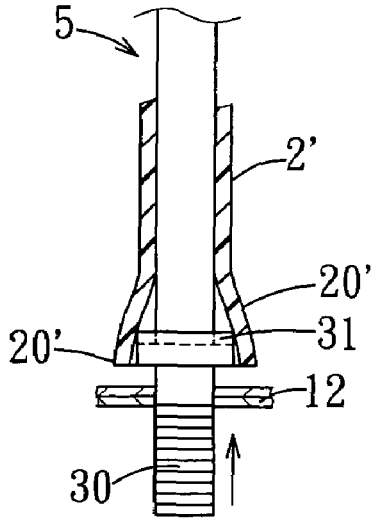
FIG. 8 is a fragmentary schematic sectional view showing the second preferred embodiment when a screw fastener is screwed into a pad-mounting seat.

FIG. 6 illustrates the second preferred embodiment of a screw fastener assembly according to this invention, which is a modification of the first preferred embodiment. In this embodiment, the second end 21' of the sleeve 2' is frustoconical, converges toward the first end 20' of the sleeve 2', and is adapted for guiding insertion of the screw driver 5 into the sleeve 2', as shown in FIG. 7. Furthermore, the first end 20' of the sleeve 2' is frustoconical, converges toward the second end 21' of the sleeve 2', and is adapted for guiding insertion of the head portion 31 of the screw fastener 3 into the sleeve 2' when moving the screw fastener 3 coupled to the pad-mounting seat 12 away from the pad-mounting seat 12, as shown in FIG. 8.

In sum, due to the presence of the sleeve 2, 2', the screw fastener 3 having a relatively small size can be easily and accurately screwed into the threaded hole 121 in the pad-mounting seat 12.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A screw fastener assembly adapted for use with an object, the object having a surface formed with a threaded hole, said screw fastener assembly comprising:

a screw fastener having a shank portion that has a connecting end and a free end which are opposite to each other, and a head portion connected to said connecting end of said shank portion, said head portion having an engaging side formed with an engaging groove; and a resilient sleeve having opposite first and second ends, said sleeve being sleeved on said head portion of said screw fastener in a close-fitting manner such that said free end of said shank portion of said screw fastener extends outwardly of said first end of said sleeve, said sleeve having a uniform thickness;

said sleeve being adapted to permit extension of a bit of a screw driver thereinto via said second end and being adapted to be sleeved on the screw driver in a close-fitting manner, said engaging groove in said engaging side of said head portion of said screw fastener being adapted to engage the bit of the screw driver such that the screw driver is capable of moving and rotating an assembly of said screw fastener and said sleeve until said first end of said sleeve comes into contact with the surface of the object so as to allow movement of said screw fastener relative to said sleeve and the threaded hole in the object;

wherein said second end of said sleeve is frustoconical, converges toward said first end of said sleeve, and is adapted for guiding insertion of the screw driver into said sleeve.

2. The screw fastener as claimed in claim 1, wherein said first end of said sleeve is frustoconical, converges toward said second end of said sleeve, and is for guiding insertion of said head portion of said screw fastener into said sleeve.

* * * * *